US006494794B1

(12) United States Patent
Ohama

(10) Patent No.: US 6,494,794 B1
(45) **Date of Patent: *Dec. 17, 2002**

(54) TWO-PIECE SOLID GOLF BALL

(75) Inventor: Keiji Ohama, Akashi (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/680,220

(22) Filed: Oct. 6, 2000

(30) Foreign Application Priority Data

Oct. 6, 1999 (JP) ..... 11-285472

(51) Int. Cl.[7] ..... A63B 37/00; A63B 37/04; A63B 37/06

(52) U.S. Cl. ..... 473/371; 473/351

(58) Field of Search ..... 473/351, 367, 473/368, 370, 371, 372, 373, 374, 376, 377, 378

(56) References Cited

U.S. PATENT DOCUMENTS 4,570,937 A * 2/1986 Yamada ..... 473/372
5,033,748 A * 7/1991 Ebilsuno ..... 473/371
5,403,010 A * 4/1995 Yabuki et al. ..... 473/372
5,490,673 A * 2/1996 Hiraoka ..... 473/372
5,516,110 A * 5/1996 Yabuki et al. ..... 273/DIG. 22
5,574,107 A * 11/1996 Hiraoka et al. ..... 473/372
5,776,012 A * 7/1998 Moriyama et al. ..... 473/372
5,795,247 A * 8/1998 Yokota et al. ..... 473/374
5,803,833 A * 9/1998 Nakamura et al. ... 273/DIG. 20
5,803,834 A 9/1998 Yamagishi et al.
6,302,810 B2 * 10/2001 Yokota ..... 473/372
6,379,268 B1 * 4/2002 Yamagishi et al. ..... 473/371

FOREIGN PATENT DOCUMENTS

JP 9-2390967 9/1997

OTHER PUBLICATIONS

Callister, Jr., William D., Materials Science and Engineering: An Introduction, 4th Edition. New York: John Wiley & Sons, Inc., 1997, p. 494–495.*

* cited by examiner

*Primary Examiner*—Paul T. Sewell
*Assistant Examiner*—Alvin A. Hunter, Jr.
(74) *Attorney, Agent, or Firm*—Birch, Stewart, Kolasch & Birch, LLP

(57) ABSTRACT

A two-piece solid golf ball has good shot feel, excellent flight performance and durability. The JIS-C hardness of core is A, core inward JIS-C hardness at 5 mm inward from the core surface is B, JIS-C surface hardness of the core is C, cover JIS-C hardness is D, distance in mm between center of core and point 5 mm inward from surface of core is K and radius of ball is L, the golf ball satisfies relations: $65 \leqq A \leqq 69$, $83 \leqq B \leqq 87$, C is lower than B by 1 to 5, and $1.2 \leqq [)D-B)/(L-K)]/[(B-A)/K] \leqq 2.5$; and when deformation amount of core at initial load of 10 kgf to final load of 130 kgf is a, and deformation of golf ball when applying initial load of 10 kgf to final load of 130 kgf is b, the deformation difference (a–b) is 0.5 to 0.9.

4 Claims, No Drawings

TWO-PIECE SOLID GOLF BALL

FIELD OF THE INVENTION

The present invention relates to a two-piece solid golf ball. More particularly, it relates to a two-piece solid golf ball having good shot feel at the time of hitting, excellent flight performance and excellent durability.

BACKGROUND OF THE INVENTION

Many types of golf balls are commercially selling, but two-piece solid golf balls and thread wound golf balls are generally used for round games. The two-piece solid golf ball, when compared with the thread wound golf ball, has longer flight distance and better durability.

In order to improve the performance of the two-piece solid golf ball, there have been many proposals. The two-piece solid golf balls, of which the performances, such as flight distance (rebound characteristics), durability, shot feel, controllability are improved by adjusting a hardness and hardness distribution of the core to a proper range, have been proposed in, for example, Japanese Patent Kokoku Publication Nos. 21426/1986, 44302/1993, 98206/1996, Japanese Patent Kokai Publication Nos. 182278/1990, 98949/1994, 154357/1994, 327792/1994, 194732/1995, 239067/1997, and the like.

Japanese Patent Kokoku Publication No. 21426/1986 suggests a two-piece golf ball in which a hardness distribution of the core is controlled such that a JIS-C hardness of the surface layer is 72 to 78, a hardness at a distance of 5 mm inner from the surface in the direction of the center point is 77 to 83, a hardness at a distance of 10 mm inner from the surface is 72 to 80, a hardness at a distance of 15 mm inner from the surface is 67 to 75, and a hardness at a distance of more than 15 mm inner from the surface is less than 75. However, the golf ball has low surface hardness of the core and has poor rebound characteristics.

Japanese Patent Kokoku Publication No. 44302/1993 suggests a two-piece golf ball in which a hardness distribution of the core is controlled such that a hardness in JIS-C hardness at a distance of less than 10 mm from the center point of the core is 60 to 79 and a hardness at a distance of more than 10 mm from the center point is 80 to 90, and a deformation amount when applying from an initial load of 10 kgf to a final load of 130 kgf is 1.9 to 2.4 mm. However, the resulting golf ball has poor shot feel, because the golf ball has small deformation amount and is hard.

Japanese Patent Kokoku Publication No. 98206/1996 suggests a two-piece golf ball in which a hardness distribution of the core is controlled such that a hardness difference in JIS-A hardness between the center point and the periphery of the core is not more than 10%. However, it is difficult to improve both the shot feel and flight performance of the golf ball, because of only a hardness difference between the center point and the periphery of the core is considered.

Japanese Patent Kokai Publication No. 182278/1990 suggests a two-piece golf ball in which a hardness distribution of the core is controlled such as to substantially decrease the hardness from the surface to the center point of the core, and a relation of the hardness with the distance from the surface is adjusted to a specified range. However, the resulting golf ball has poor shot feel, because the surface of the core has the highest hardness in the core and the center hardness of the core is high.

Japanese Patent Kokai Publication Nos. 98949/1994 and 154357/1994 suggest a two-piece golf ball in which a hardness distribution of the core is controlled so as to increase hardness in order, a center point, 5 to 10 mm from the center point, 15 mm from the center point and a surface. However, the resulting golf ball has poor shot feel, because the surface of the core has the highest hardness in the core.

Japanese Patent Kokai Publication No. 327792/1994 suggests a two-piece golf ball in which a hardness distribution in JIS-C hardness of the core is controlled such that a center hardness is 65 to 79, a hardness at a distance of 5 mm from the center point in the direction of the surface is 70 to 80, a hardness at a distance of 10 mm from the center point in the direction of the surface is 73 to 80, a hardness at a distance of 15 mm from the center point in the direction of the surface is 75 to 82, the surface hardness is 70 to 85, and a hardness difference between adjacent locations of the measurements is not more than 5. However, since the center hardness of the core is high, the shot feel of the golf ball is poor.

Japanese Patent Kokai Publication No. 194732/1995 suggests a two-piece golf ball, of which a core has a center hardness in JIS-C hardness of 40 to 57, a surface hardness in JIS-C hardness of 70 to 95, and the difference between the surface hardness and center hardness of 20 to 40. However, since the center hardness of the core is low, the durability of the golf ball is poor and the rebound characteristics of the golf ball are sufficiently obtained.

Japanese Patent Kokai Publication No. 239067/1997 suggests a two-piece golf ball, of which a core has a surface hardness in JIS-C hardness of not more than 85, and a hardness distribution that a center hardness is smaller than the surface hardness by 8 to 20 and a hardness at a distance of not more than 5 mm from the surface is smaller than the surface hardness by not more than 8. However, since the surface hardness is the highest in the core, the shot feel of the golf ball is poor.

It is required to solve the above problem and to provide a two-piece golf ball having not only better flight performance and better durability but also having better shot feel. It is further required for the two-piece solid golf ball to improve the above-mentioned physical properties, especially shot feel, because a multi-piece solid golf ball having excellent flight performance and good shot feel has been introduced into market. When hit by a player who swings a golf club at high head speed, good shot feel, excellent flight performance and excellent durability are not accomplished only by softening the golf ball.

OBJECTS OF THE INVENTION

A main object of the present invention is to provide a two-piece solid golf ball having good shot feel at the time of hitting, excellent flight performance and excellent durability.

According to the present invention, the object described above has been accomplished by adjusting a center hardness, a hardness at a distance of 5 mm inward from the surface and a hardness distribution of the core, and a difference between a deformation amount of the core and that of the golf ball when applying from an initial load of 10 kgf to a final load of 130 kgf to a specified range, thereby providing a two-piece solid golf ball having good shot feel, excellent flight performance and excellent durability, when hit by a player who swings a golf club at high head speed.

SUMMARY OF THE INVENTION

The present invention provides a two-piece solid golf ball comprising a core and a cover formed on the core, wherein when a center hardness in JIS-C hardness of the core is represented by A, a core inward hardness in JIS-C hardness at a distance of 5 mm inward from the surface of the core is represented by B, a surface hardness in JIS-C hardness of the core is represented by C, a cover hardness in JIS-C hardness is represented by D, a distance in mm between a center point of the core and a point of 5 mm inward from the surface of the core is represented by K and a radius of the golf ball is represented by L, the golf ball satisfies the following relations:

$65 \leqq A \leqq 69$, $83 \leqq B \leqq 87$,

C is lower than B by 1 to 5, and $1.2 \leqq [(D-B)/(L-K)]/[(B-A)/K] \leqq 2.5$; and when a deformation amount of the core when applying from an initial load of 10 kgf to a final load of 130 kgf is represented by "a", and a deformation amount of the golf ball when applying from an initial load of 10 kgf to a final load of 130 kgf is represented by "b", the value of deformation difference (a–b) is within the range of 0.5 to 0.9.

In order to practice the present invention suitably, it is desired that the cover hardness (D) be not less than 97, the deformation amount (b) of the golf ball when applying from an initial load of 10 kgf to a final load of 130 kgf be within the range of 2.45 to 2.75 mm, and the core be formed from a rubber composition comprising 3 to 50 parts by weight of a vulcanized rubber powder, based on 100 parts by weight of a base rubber.

According to an investigation of flight performance of a two-piece solid golf ball comprising a core and a cover formed on the core, when the hardness difference from the center point to the surface of the core is small, that is, the core has generally even hardness distribution, energy loss with deformation of the core at the time of hitting is small. Therefore the rebound characteristics are sufficiently obtained, but the shot feel is hard and poor, because the hardness nearby the center point is high. When the core has a gradient of the hardness that the center point is soft and the surface is hard, the shot feel is soft and good, while maintaining the good rebound characteristics. However, when the hardness is too high, the shot feel is poor, and the durability is poor.

In the present invention, according to the investigation described above, a two-piece solid golf ball having good shot feel at the time of hitting, excellent flight performance and excellent durability can be obtained by adjusting a center hardness, a surface hardness and a hardness nearby the surface of the core, and a hardness of the cover to a specified range.

DETAILED DESCRIPTION OF THE INVENTION

The two-piece solid golf ball of the present invention comprises a core, and a cover formed on the core. The core is obtained by press molding and vulcanizing a rubber composition using a method and condition, which have been conventionally used for preparing the core of solid golf balls. The rubber composition contains a base rubber, a co-crosslinking agent, an organic peroxide, a filler, an anti-oxidant and the like.

The base rubber used for the core of the present invention may be natural rubber and/or synthetic rubber, which has been conventionally used for solid golf balls. Preferred is high-cis polybutadiene rubber containing not less than 40%, preferably not less than 80% of a cis-1,4 bond. The high-cis polybutadiene rubber may be mixed with natural rubber, polyisoprene rubber, styrene-butadiene rubber, ethylene-propylene-diene rubber (EPDM) and the like.

The co-crosslinking agent can be a metal salt of α,β-unsaturated carboxylic acid, including mono or divalent metal salts, such as zinc or magnesium salts of α,β-unsaturated carboxylic acids having 3 to 8 carbon atoms (e.g. acrylic acid, methacrylic acid, etc.). Preferred co-crosslinking agent is zinc acrylate because it imparts high rebound characteristics to the resulting golf ball. The amount of the metal salt of the unsaturated carboxylic acid in the rubber composition may be from 20 to 40 parts by weight, preferably from 25 to 34 parts by weight, based on 100 parts by weight of the base rubber. When the amount of the co-crosslinking agent is smaller than 20 parts by weight, the core is too soft, and the rebound characteristics are degraded, which reduces the flight distance, and the shot feel is heavy. On the other hand, when the amount of the co-crosslinking agent is larger than 40 parts by weight, the core is too hard, and shot feel is poor.

The organic peroxide includes, for example, dicumyl peroxide, 1,1-bis(t-butylperoxy)-3,3,5-trimethylcyclohexane, 2,5-dimethyl-2,5-di(t-butylperoxy) hexane, di-t-butyl peroxide and the like. Preferred organic peroxide is dicumyl peroxide. The organic peroxide is thermally dissociated to form free radical, and the degree of crosslink between the co-crosslinking agent and the base resin is high, thereby improving the rebound characteristics. The amount of the organic peroxide may be from 0.3 to 3.0 parts by weight, preferably 0.5 to 2.5 parts by weight, based on 100 parts by weight of the base rubber. When the amount of the organic peroxide is smaller than 0.3 parts by weight, the core is too soft, and the rebound characteristics are degraded, which reduces flight distance, and the shot feel is heavy. On the other hand, when the amount of the organic peroxide is larger than 3.0 parts by weight, the core is too hard, and the shot feel is poor.

In the rubber composition used for the core of the golf ball of the present invention, it is preferable to contain a vulcanized rubber powder in addition to the above components. A combination of soft core and hard cover is used in order to accomplish good shot feel and excellent flight performance, but there is a problem that the durability is poor in the golf ball using the combination. The technical effects of improving the durability and reducing the impact force at the time of hitting are obtained by using the vulcanized rubber powder in the rubber composition for the core. The amount of the vulcanized rubber powder is 3 to 50 parts by weight, preferably 10 to 50 parts by weight, more preferably 15 to 45 parts by weight, based on 100 parts by weight of the base rubber. When the amount is smaller than 3 parts by weight, the technical effect of improving the durability by using the vulcanized rubber powder is sufficiently obtained. On the other hand, when the amount is larger than 50 parts by weight, the rubber composition is cut when mixing, and the workability is degraded.

The vulcanized rubber powder may be obtained by pulverizing a vulcanized article of the rubber composition, which has been typically used for the core of solid golf balls. But it is preferably obtained by vulcanizing the rubber composition for the core described above at the vulcanization condition described later. The vulcanized rubber powder preferably has a JIS-C hardness of 40 to 95 before pulverizing as physical properties of the rubber. When the hardness is out of the range, the durability of the resulting golf ball is degraded. The vulcanized rubber powder has an average particle diameter of not more than 1 mm, and practically has that of not less than about 0.1 μm. When the average particle diameter is larger than 1 mm, the dispersibility in the rubber composition is degraded.

The rubber composition for the core of the golf ball of the present invention can contain other components, which have been conventionally used for preparing the core of solid golf balls, such as inorganic filler (such as zinc oxide, barium sulfate, calcium carbonate and the like), high specific gravity metal powder filler (such as tungsten powder, molybdenum powder and the like), antioxidant or peptizing agent. If used, an amount of the antioxidant is preferably 0.2 to 0.5 parts by weight, based on 100 parts by weight of the base rubber.

The core is obtained by mixing the above rubber composition, and vulcanizing and press-molding it in a mold under the condition, which is not limited but at 130 to 180° C. and 30 to 100 kgf/cm$^2$ for 15 to 60 minutes.

The core of the golf ball of the present invention has a center hardness in JIS-C hardness of 65 to 69, preferably 66 to 68. When the center hardness of the core is smaller than 65, the core hardness is too low, and the rebound characteristics are degraded, which reduces the flight distance. In addition, the durability is poor. On the other hand, when the center hardness of the core is larger than 69, the core hardness is too high, and the shot feel is hard and poor. In addition, the launch angle is small, which reduces the flight distance, because the deformation at the time of hitting is small.

The core of the golf ball of the present invention has a hardness at a distance of 5 mm inward from the surface in JIS-C hardness of 83 to 87, preferably 83 to 86. When the hardness is lower than 83, it is near to the center hardness, and the core has even hardness distribution. Therefore the shot feel is poor. On the other hand, when the hardness is higher than 87, the core hardness is too high, the shot feel is poor and the durability is poor.

The surface hardness of the core of the golf ball of the present invention is lower than the hardness at a distance of 5 mm inward from the surface by 1 to 5, preferably 1 to 4, more preferably 2 to 4. The golf ball having small impact force and good shot feel, while maintaining high rebound characteristics, is obtained by accomplishing the hardness distribution of the core. When the difference (B−C) between the surface hardness (C) and the hardness at a distance of 5 mm inward from the surface (B) is smaller than 1, the technical effect of improving the shot feel accomplished by lowering the surface hardness is not obtained. On the other hand, the difference is larger than 5, the rebound characteristics of the core are degraded, which reduces the flight distance of the resulting golf ball.

It is desired that the core of the golf ball of the present invention have a surface hardness in JIS-C hardness of 78 to 86, preferably 79 to 85, more preferably 79 to 84. When the surface hardness is not more than 78, the rebound characteristics of the core are degraded, which reduces the flight distance. On the other hand, when the surface hardness of the core is higher than 86, the shot feel is poor.

The term "a surface hardness of a core" as used herein refers to the hardness, which is obtained by measuring a hardness at the surface of the resulting core as described above. The hardness other than the surface hardness of the core, that is, the term "a center hardness of a core" and "a hardness at a distance of 5 mm inward from the surface of the core" as used herein refers to the hardness, which is obtained by cutting the core into two equal parts and then measuring a hardness at center point and at a distance of 5 mm inward from the surface in section.

It is desired that the core of the golf ball of the present invention have a deformation amount of 2.8 to 3.7 mm, preferably 3.0 to 3.5 mm when applying from an initial load of 10 kgf to a final load of 130 kgf on the core. When the deformation amount is smaller than 2.8 mm, the core is too hard, and the shot feel of the resulting golf ball is poor. On the other hand, when the deformation amount is larger than 3.7 mm, the core is too soft, and the durability is poor and the rebound characteristics are degraded, which reduces the flight distance of the resulting golf ball.

It is desired that the core of the golf ball of the present invention have a diameter of 37.5 to 40.5 mm, preferably 38.0 to 40.0 mm. When the diameter of the core is smaller than 37.5 mm, the cover is too thick, and the performance of the core does not sufficiently exhibit. Therefore the shot feel of the resulting golf ball is poor. On the other hand, when the diameter is larger than 40.5 mm, the cover is too thin, and the durability is poor. A cover is then covered on the core.

It is desired that the cover of the golf ball of the present invention have a JIS-C hardness of not less than 97, preferably 98 to 100. When the cover hardness is smaller than 97, the rebound characteristics of the cover are degraded and the spin amount of the resulting golf ball when hit at high head speed is large, which reduces the flight distance of the golf ball.

When assuming that the cover hardness is represented as D, the center hardness of the core is represented as A, the hardness at a distance of 5 mm inward from the surface of the core is represented as B, a distance between the center point and the point of 5 mm inward from the surface of the core is represented as K, and a radius of the golf ball is represented as L, it is required that the golf ball satisfy the following formula:

$$1.2 \leqq [(D-B)/(L-K)]/[(B-A)/K] \leqq 2.5.$$

It is found that the durability and shot feel can be improved by attending to a hardness gradient of an inner portion of the golf ball and a hardness gradient of an outer portion of the golf ball, that is, adjusting the both hardness gradient so that the hardness gradient of the outer portion of the golf ball is slightly larger than that of the inner portion of the golf ball. The hardness gradient of the inner portion, which is represented by [(B−A)/K] in the above formula, refers to the hardness gradient between the center point and 5 mm inward from the surface of the core, where the hardness is the highest in the core. The hardness gradient of the outer portion, which is represented by [(D−B)/(L−K)] in the above formula, refers to the hardness gradient between the cover at the surface of the golf ball and 5 mm inward from the surface of the core.

When the hardness gradient of the inner portion is the same as the hardness gradient of the outer portion, that is, when a ratio of both hardness gradient:

$$[(D-B)/(L-K)]/[(B-A)/K]$$

is 1.0, the deformation between the core and cover is smooth, and the shot feel is good. However, the cover hardness is low and the flight distance of the golf ball is reduced, or the hardness gradient in the core is too large and the durability of the golf ball is poor. The golf ball having good shot feel at the time of hitting, excellent flight performance and excellent durability can be obtained by adjusting the ratio of the hardness gradient of the inner portion to that of the outer portion to the range of the present invention, which is within the range of 1.2 to 2.5. When the ratio of the hardness gradient is smaller than 1.2, the cover hardness is low, and the spin amount is large, which reduces the flight distance. On the other hand, when the ratio of the hardness gradient is lager than 2.5, the cover hardness is too high.

Therefore the durability is poor, or the shot feel is poor. Otherwise, the hardness gradient of the core is small and even, and the shot feel is poor. Therefore it is desired that the ratio of the hardness gradient be within the range of preferably 1.3 to 2.3, more preferably 1.4 to 2.3, most preferably 1.4 to 2.0.

It is desired that the cover of the golf ball of the present invention have a thickness of 1.60 to 2.50 mm, preferably 1.85 to 2.40 mm, more preferably 1.85 to 2.35 mm. When the thickness is smaller than 1.60 mm, the technical effects accomplished by the presence of the cover are not sufficiently obtained, and the durability is poor. In addition, the rebound characteristics are degraded, which reduces the flight distance. On the other hand, the thickness is larger than 2.50 mm, the technical effects accomplished by the presence of the core are not sufficiently obtained, and the shot feel is poor. In addition, the deformation amount is small, and the launch angle is small, which reduces the flight distance.

The material used for the cover of the present invention is not limited, as long as the above physical properties are imparted to it, but includes thermoplastic resin, particularly ionomer resin, which has been conventionally used for the cover of golf balls, as a base resin. The ionomer resin may be a copolymer of ethylene and α,β-unsaturated carboxylic acid, of which a portion of carboxylic acid groups is neutralized with metal ion, or a terpolymer of ethylene, α,β-unsaturated carboxylic acid and α,β-unsaturated carboxylic acid ester, of which a portion of carboxylic acid groups is neutralized with metal ion. Examples of the α,β-unsaturated carboxylic acid in the ionomer include acrylic acid, methacrylic acid, fumaric acid, maleic acid, crotonic acid and the like, preferred are acrylic acid and methacrylic acid. Examples of the α,β-unsaturated carboxylic acid ester in the ionomer include methyl ester, ethyl ester, propyl ester, n-butyl ester and isobutyl ester of acrylic acid, methacrylic acid, fumaric acid, maleic acid and the like. Preferred are acrylic acid esters and methacrylic acid esters. The metal ion which neutralizes a portion of carboxylic acid groups of the copolymer or terpolymer includes a sodium ion, a potassium ion, a lithium ion, a magnesium ion, a calcium ion, a zinc ion, a barium ion, an aluminum, a tin ion, a zirconium ion, cadmium ion and the like. Preferred are sodium ions, zinc ions, magnesium ions and the like, in view of rebound characteristics, durability and the like.

The ionomer resin is not limited, but examples thereof will be shown by a trade name thereof. Examples of the ionomer resins, which are commercially available from Mitsui Du Pont Polychemical Co., Ltd. include Hi-milan 1555, Hi-milan 1557, Hi-milan 1605, Hi-milan 1652, Hi-milan 1702, Hi-milan 1705, Hi-milan 1706, Hi-milan 1707, Hi-milan 1855, Hi-milan 1856 and the like. Examples of the ionomer resins, which are commercially available from Du Pont Co., include Surlyn 8945, Surlyn 9945, Surlyn AD8511, Surlyn AD8512, Surlyn AD8542 and the like. Examples of the ionomer resins, which are commercially available from Exxon Chemical Co., include Iotek 7010, Iotek 8000 and the like. These ionomer resins may be used alone or in combination of two or more thereof.

As the materials suitably used in the cover of the present invention, the above ionomer resin may be used alone, but the ionomer resin may be used in combination with at least one of thermoplastic elastomer and the like. Examples of the thermoplastic elastomers are not limited, but include polyamide thermoplastic elastomer, which is commercially available from Toray Co., Ltd. under the trade name of "Pebax" (such as "Pebax 2533"); polyester thermoplastic elastomer, which is commercially available from Toray-Do Pont Co., Ltd. under the trade name of "Hytrel" (such as "Hytrel 3548", "Hytrel 4047"); polyurethane thermoplastic elastomer, which is commercially available from Takeda Verdishe Co., Ltd. under the trade name of "Elastoran" (such as "Elastoran ET880"); and the like.

The cover used in the present invention may optionally contain fillers (such as barium sulfate, calcium carbonate, etc.), coloring agents (such as titanium dioxide, etc.), and the other additives such as a dispersant, an antioxidant, a UV absorber, a photostabilizer and a fluorescent agent or a fluorescent brightener, etc., in addition to the resin component, as long as the addition of the additives does not deteriorate the desired performance of the golf ball cover. The amount of the coloring agent is preferably 0.1 to 5.0 parts by weight, based on 100 parts by weight of the cover resin component.

A method of covering the core with the cover is not specifically limited, but may be a well-known method, which has been conventionally used for forming golf ball cover. For example, there can be used a method comprising molding the cover composition into a semi-spherical half-shell in advance, covering the solid core with the two half-shells, followed by pressure molding, or a method comprising injection molding the cover composition directly on the core to cover it. At the time of molding the cover, many depressions called "dimples" may be optionally formed on the surface of the golf ball. Furthermore, paint finishing or marking with a stamp may be optionally provided after the cover is molded for commercial purposes.

It is desired that the golf ball of the present invention have a deformation amount of 2.45 to 2.75 mm, preferably 2.5 to 2.7 mm when applying from an initial load of 10 kgf to a final load of 130 kgf on the golf ball. When the deformation amount is smaller than 2.45 mm, the golf ball is too hard, and the shot feel is poor. On the other hand, when the deformation amount is larger than 2.75 mm, the golf ball is too soft when hit by a golfer who swings a golf club at high head speed, and the durability is poor and the rebound characteristics are degraded, which reduces the flight distance. When the deformation amount of the golf ball is represented as "b", and the deformation amount of the core when applying from an initial load of 10 kgf to a final load of 130 kgf as described above is represented as "a", it is desired that the value of (a–b) be within the range of 0.5 to 0.9, preferably 0.55 to 0.85. When the value of (a–b) is smaller than 0.5, the core is too hard compared with the cover, and the shot feel is poor. On the other hand, when the value of (a–b) is larger than 0.9, the core is too soft compared with the cover, and the durability is degraded. The two-piece solid golf ball of the present invention is formed, so that it has a diameter of not less than 42.67 mm and a weight of not more than 45.93 g, according to the PGA rule.

EXAMPLES

The following Examples and Comparative Examples further illustrate the present invention in detail but are not to be construed to limit the scope of the present invention.

Preparation of Vulcanized Rubber Powder

The rubber composition having the formulation shown in Table 1 was mixed with a mixing roll, vulcanized by press-molding at 160° C. for 30 minutes and then pulverized to obtain a vulcanized rubber powder having an average particle diameter of 100 μm. The resulting vulcanized rubber had a JIS-C hardness of 85 before pulverizing.

TABLE 1

| Vulcanized rubber powder composition | Amount (parts by weight) |
|---|---|
| BR11 *1 | 100 |
| Zinc acrylate | 25 |
| Zinc oxide | 20 |
| Organic peroxide *2 | 1.5 |

Examples 1 to 5 and Comparative Examples 1 to 4

Production of Core

The rubber compositions for the core having the formulations shown in Table 2 (Examples) and Table 3 (Comparative Examples) were mixed with a mixing roll, and then vulcanized by press-molding at the vulcanization condition shown in the same Tables to obtain spherical cores having a diameter of 38.8 mm. The hardness distribution and deformation amount of the resulting core were measured. The results are shown in Table 5 (Examples) and table 6 (Comparative Examples). The test methods are described later.

TABLE 2

| | (parts by weight) Example No. | | | | |
|---|---|---|---|---|---|
| | 1 | 2 | 3 | 4 | 5 |
| Core composition | | | | | |
| BR11 *1 | 100 | 100 | 100 | 100 | 100 |
| Zinc acrylate | 25 | 25 | 26 | 24 | 25 |
| Zinc oxide | 20 | 20 | 20 | 20 | 20 |
| Organic peroxide *2 | 1.5 | 1.8 | 1.2 | 1.2 | 1.5 |
| Vulcanized rubber powder | 15 | 15 | 15 | 15 | — |
| Vulcanization condition | | | | | |
| Vulcanization temperature (° C.) | 155 | 160 | 150 | 150 | 155 |
| Vulcanization time (minute) | 20 | 15 | 20 | 19 | 20 |

TABLE 3

| | (parts by weight) Comparative Example No. | | | |
|---|---|---|---|---|
| | 1 | 2 | 3 | 4 |
| Core composition | | | | |
| BR11 *1 | 100 | 100 | 100 | 100 |
| Zinc acrylate | 25 | 25 | 23 | 22 |
| Zinc oxide | 20 | 20 | 20 | 20 |
| Organic peroxide *2 | 1.3 | 1.5 | 1.2 | 1.5 |
| Vulcanized rubber powder | 15 | 15 | 15 | 15 |
| Vulcanization condition | | | | |
| Vulcanization temperature (° C.) | 155 | 155 | 146 | 155 |
| Vulcanization time (minute) | 25 | 20 | 35 | 20 |

*1: High-cis Polybutadiene rubber (trade name "BR11") available from JSR Co., Ltd. (Content of 1,4-cis-polybutadiene: 96%)
*2: Dicumyl peroxide Preparation of Cover Compositions The formulation materials shown in Table 3 were mixed using a kneading type twin-screw extruder to obtain pelletized cover compositions. The extrusion condition was, a screw diameter of 45 mm, a screw speed of 200 rpm, and a screw L/D of 35.

The formulation materials were heated at 200 to 260° C. at the die position of the extruder.

TABLE 4

| | (parts by weight) | |
|---|---|---|
| Cover composition | I | II |
| Hi-milan 1605 *3 | 50 | 20 |
| Hi-milan 1706 *4 | 50 | 20 |
| Hi-milan 1855 *5 | — | 60 |

*3: Hi-milan 1605 (trade name), ethylene-methacrylic acid copolymer ionomer resin obtained by neutralizing with sodium ion, manufactured by Mitsui Du Pont Polychemical Co., Ltd.
*4: Hi-milan 1706 (trade name), ethylene-methacrylic acid copolymer ionomer resin obtained by neutralizing with zinc ion, manufactured by Mitsui Du Pont Polychemical Co., Ltd.
*5: Hi-milan 1855 (trade name), ethylene-methacrylic acid-isobutyl acrylate terpolymer ionomer resin obtained by neutralizing with zinc ion, manufactured by Mitsui Du Pont Polychemical Co., Ltd.

Production of Golf Ball

The cover compositions were covered on the resulting core by injection molding to form a cover layer having a thickness of 2.0 mm. The hardness of the resulting cover layer was measured, and the ratio of hardness gradient was calculated from the hardness and the core hardness described above. The results are shown in Table 5 (Example) and Table 6 (Comparative Example). Then, deflashing, surface pretreatment for painting, paint and the like, which are generally done on the surface of a golf ball, were conducted on the surface to produce a golf ball having a weight of 45.4 g and a diameter of 42.8 mm. With respect to the resulting golf balls, the deformation amount, coefficient of restitution, durability, flight distance and shot feel at the time of hitting were measured or evaluated, and the ratio of deformation amount (a/b) was calculated from the deformation amount of the core (a) and the deformation amount of the golf ball (b). The results are shown in Table 5 (Example) and Table 6 (Comparative Example). The test methods are as follows.

Test Method (1) Hardness of Core

The JIS-C hardness was measured at the center point, at the surface and at a distance of 5 mm inward from the surface of the core. The surface hardness of the core (C) was determined by measuring the hardness at the surface of the resulting core. The center hardness of the core (A) and the hardness at a distance of 5 mm inward from the surface of the core (B) were determined by measuring a hardness at the center point and at a distance of 5 mm inward from the surface of the core in section, after the resulting core is cut into two equal parts. The JIS-C hardness was measured with a JIS-C hardness meter according to JIS K 6301.

(2) Hardness of Cover

The JIS-C hardness of the cover is determined by measuring a hardness at the surface of the resulting golf ball, which is formed by covering the core with the cover. The JIS-C hardness was measured with a JIS-C hardness meter according to JIS K 6301.

(3) Deformation Amount

The deformation amount was determined by measuring a deformation amount when applying an initial load of 10 kgf to a final load of 130 kgf on the core or golf ball.

(4) Coefficient of Restitution

An aluminum cylinder having a weight of 200g struck against the golf ball at a velocity of 45 m/second, and the velocity of the cylinder and golf ball after strike were measured. The coefficient of restitution was calculated from the velocity and the weight of the cylinder and golf ball before and after strike. The measurement was conducted by using 12 golf balls for every sample (n=12), and the average is shown as the result of the golf ball, and is indicated by an index when that of Comparative Example 1 is 100.

(5) Durability

A No.1 wood club (W#1, a driver) having metal head was mounted to a swing robot manufactured by True Temper Co. and the resulting golf ball was hit at a head speed of 45 m/second to strike against an impact board, repeatedly. The durability is the number of hit until the cover of the golf ball cracks, and is indicated by an index when that of Comparative Example 1 is 100. The larger the number is, the better durability the golf ball has.

(6) Flight Performance

A No. 1 wood club (W#1, a driver) having metal head was mounted to a swing robot manufactured by True Temper Co. and the resulting golf ball was hit at a head speed of 45 m/second, the flight distance was measured. As the flight distance, carry that is a distance to the dropping point of the hit golf ball was measured. The measurement was conducted by using 12 golf balls for every sample (n=12), and the average is shown as the result of the golf ball.

(7) Shot Feel

The shot feel of the resulting golf ball was evaluated by 10 golfers according to practical hitting test using a No. 1 wood club (W#1, a driver). The evaluation criteria are as follows.

Evaluation Criteria

○○: Not less than 8 golfers out of 10 golfers felt that the golf ball has low impact force at the time of hitting, and has the rebound characteristics and good shot feel.

○: Six to 7 golfers out of 10 golfers felt that the golf ball has low impact force at the time of hitting, and has the rebound characteristics and good shot feel.

Δ: Four to 5 golfers out of 10 golfers felt that the golf ball has low impact force at the time of hitting, and has the rebound characteristics and good shot feel.

x: Not more than 3 golfers out of 10 golfers felt that the golf ball has low impact force at the time of hitting, and has the rebound characteristics and good shot feel.

TABLE 5

| Test item | Example No. 1 | 2 | 3 | 4 | 5 |
|---|---|---|---|---|---|
| (Core) | | | | | |
| JIS-C hardness | | | | | |
| Center point (A) | 67 | 66 | 68 | 69 | 66 |
| 5 mm from the surface (B) | 85 | 86 | 84 | 83 | 86 |
| Surface (b) | 83 | 84 | 82 | 79 | 84 |
| Hardness difference (B − C) | 2 | 2 | 2 | 4 | 2 |
| Deformation amount (a) (mm) | 3.3 | 3.4 | 3.1 | 3.2 | 3.2 |
| (Cover) | | | | | |
| Composition | I | I | I | I | I |
| Hardness (D) (JIS-C) | 99 | 99 | 99 | 99 | 99 |
| Ratio of hardness gradient *6 | 1.60 | 1.34 | 1.93 | 2.35 | 1.34 |
| (Ball) | | | | | |
| Deformation amount (b) (mm) | 2.6 | 2.65 | 2.5 | 2.6 | 2.65 |
| Deformation amount difference (a − b) | 0.7 | 0.75 | 0.6 | 0.6 | 0.55 |
| Coefficient of restitution | 100 | 100 | 101 | 100 | 100 |
| Durability | 105 | 105 | 109 | 103 | 102 |
| Flight distance (yard) | 229 | 229 | 230 | 228 | 228 |
| Shot feel | ○○ | ○○ | ○○ | ○ | ○ |

TABLE 6

| Test item | Comparative Example No. 1 | 2 | 3 | 4 |
|---|---|---|---|---|
| (Core) | | | | |
| JIS-C hardness | | | | |
| Center point (A) | 67 | 67 | 72 | 62 |
| 5 mm from the surface (B) | 85 | 85 | 81 | 82 |
| Surface (b) | 86 | 83 | 79 | 80 |
| Hardness difference (B − C) | −1 | 2 | 2 | 2 |
| Deformation amount (a) (mm) | 3.2 | 3.3 | 3.1 | 3.6 |
| (Cover) | | | | |
| Composition | I | II | I | I |
| Hardness (D) (JIS-C) | 99 | 94 | 99 | 99 |
| Ratio of hardness gradient *6 | 1.60 | 1.03 | 4.11 | 1.75 |
| (Ball) | | | | |
| Deformation amount (b) (mm) | 2.6 | 2.85 | 2.5 | 2.9 |
| Deformation amount difference (a − b) | 0.6 | 0.45 | 0.6 | 0.7 |
| Coefficient of restitution | 100 | 97 | 101 | 98 |
| Durability | 100 | 104 | 103 | 101 |
| Flight distance (yard) | 228 | 224 | 228 | 225 |
| Shot feel | Δ | Δ | Δ | ○ |

*6: Ratio of hardness gradient: [(D-B)/(L-K)]/[(B-A)/K]

L: Radius of golf ball

K: Distance between the center point and the point of 5 mm inward from the surface of the core As is apparent from the results shown in Tables 4 and 5, the golf balls of the present invention of Examples 1 to 3 have good shot feel, excellent flight distance and excellent durability, when compared with the golf balls of Comparative Examples 1 to 5.

In the golf ball of Example 4, which is within the range of the present invention and has excellent performance compared with the golf balls of Comparative Examples, the difference between the surface hardness of the core (C) and the hardness at a distance of 5 mm from the surface of the core (B) is slightly large, and the flight distance is slightly short. In addition, the ratio of hardness gradient is slightly large, and the impact force at the time of hitting is large, and the shot feel is slightly poor.

In the golf ball of Example 5, which is within the range of the present invention and has excellent performance compared with the golf balls of Comparative Examples, the core comprises no vulcanized rubber powder, and the durability is slightly poor.

On the other hand, in the golf ball of Comparative Example 1, the surface hardness of the core (C) is higher than the hardness at a distance of 5 mm from the surface of the core (B). Therefore the impact force at the time of hitting is large, and the shot feel is poor.

In the golf ball of Comparative Example 2, the ratio of hardness gradient is small, and the cover hardness is too low. Therefore the rebound characteristics are degraded, which reduces the flight distance. In addition, since the deformation amount difference is small, the cover is relatively hard for the core, and the shot feel is heavy and poor because the rebound characteristics are not sufficient.

In the golf ball of Comparative Example 3, the center hardness of the core (A) is high and the hardness at a distance of 5 mm from the surface of the core (B) is low, and thus the ratio of hardness gradient is large. Therefore the impact force at the time of hitting is large, and the shot feel is poor.

In the golf ball of Comparative Example 4, the center hardness of the core (A) is low and the hardness at a distance of 5 mm from the surface of the core (B) is low, and thus the coefficient of restitution is small, which reduces the flight distance. In addition, the shot feel is heavy and poor because the rebound characteristics are not sufficient.

What is claimed is:

1. A two-piece solid golf ball comprising a core and a cover formed on the core, wherein when a center hardness in JIS-C hardness of the core is represented by A, a core inward hardness in JIS-C hardness at a distance of 5 mm inward from the surface of the core is represented by B, a surface hardness in JIS-C hardness of the core is represented by C, a cover hardness in JIS-C hardness is represented by D, a distance in mm between a center point of the core and a point of 5 mm inward from the surface of the core is represented by K and a radius of the golf ball is represented by L, the golf ball satisfies the following relations:

$65 \leqq A \leqq 69$, $83 \leqq B \leqq 87$,

C is lower than B by 1 to 5, and $1.2 \leqq [(D-B)/(L-K)]/[(B-A)/K] \leqq 2.5$; and when a deformation amount of the core when applying from an initial load of 10 kgf to a final load of 130 kgf is represented by "a", and a deformation amount of the golf ball when applying from an initial load of 10 kgf to a final load of 130 kgf is represented by "b", the value of deformation amount difference (a–b) is within the range of 0.5 to 0.9.

2. The two-piece solid golf ball according to claim 1, wherein the cover hardness (D) is not less than 97.

3. The two-piece solid golf ball according to claim 1, wherein the deformation amount (b) of the golf ball when applying from an initial load of 10 kgf to a final load of 130 kgf is within the range of 2.45 to 2.75 mm.

4. The two-piece solid golf ball according to claim 1, wherein the core is formed from a rubber composition comprising 3 to 50 parts by weight of a vulcanized rubber powder, based on 100 parts by weight of a base rubber.

* * * * *